United States Patent [19]

Piana et al.

[11] Patent Number: 4,899,474

[45] Date of Patent: Feb. 13, 1990

[54] OPEN SLEEVE SUPPORT FOR WIRE MARKING ELEMENTS

[75] Inventors: Ivana Piana; Silvano Piana, both of Genoa, Italy

[73] Assignee: Graphoplast S.p.A., Italy

[21] Appl. No.: 665,615

[22] Filed: Oct. 29, 1984

[30] Foreign Application Priority Data

Nov. 7, 1983 [IT] Italy ..... 12659 A/83

[51] Int. Cl.[4] ..... G09F 3/00

[52] U.S. Cl. ..... 40/316; 40/658

[58] Field of Search ..... 40/316, 11 R, 10 R, 40/299, 658, 660

[56] References Cited

U.S. PATENT DOCUMENTS

| | | | |
|---|---|---|---|
| 3,534,777 | 10/1970 | Loof | 40/316 |
| 4,268,986 | 5/1981 | Piana | 40/316 |

FOREIGN PATENT DOCUMENTS

| | | | |
|---|---|---|---|
| 121454 | 10/1984 | European Pat. Off. . | |
| 655749 | 1/1938 | Fed. Rep. of Germany | 40/316 |
| 2614700 | 10/1976 | Fed. Rep. of Germany | 40/316 |
| 1321537 | 2/1963 | France | 40/316 |
| 607245 | 11/1978 | Switzerland . | |
| 960278 | 6/1964 | United Kingdom . | |

*Primary Examiner*—Joseph Falk
*Assistant Examiner*—Wenceslao J. Contreras
*Attorney, Agent, or Firm*—Jacobs & Jacobs

[57] ABSTRACT

This open sleeve support is consisting of a central flat or slightly curved part (1), preferably of constant thickness, provided with two lateral branches (2) growing more narrow downwards, the latter being connected through a small fillet, to the two flat and parallel flanges (4) bent inwards and almost reaching the center of the sleeve, so that the support can be easily fitted on cables of various size (7) by slipping the sleeve on laterally, without risk of failure, while remaining firmly in place.

12 Claims, 1 Drawing Sheet

OPEN SLEEVE SUPPORT FOR WIRE MARKING ELEMENTS

Various types of coded sleeves or bearing marking elements are known for electric wire or calbe marking. In particular, ring-shaped and C-shaped sleeves are known for this purpose.

This Patent covers essentially open sleeves, to be fitted on already connected cables, and they are therefore different from closed sleeves which have the serious drawback that the cables have to be disconnected from their terminals before the sleeves can be applied.

The main problem of such open sleeve type supports is to prevent their failure during installation while ensuring at the same time their stable positioning on the cable after their unavoidable deformation during installation, since the free ends of the C-shapes have to be forced open for application on the cable and shall then return to their initial position to keep the sleeve snugly fitted on the cable.

To this purpose, the known open sleeves are manufactured in elastic (usually plastic) material to permit this deformation during installation and wrapping around the cable. Unfortunately, however, this problem has not yet been solved in a satisfactory manner.

Sleeves in soft and flexible material are indeed easy to fit, but they don't provide sufficient stability, whereas sleeves in hard but elastic material ensure greater stability but may easily break during installation.

In addition, the known open-type sleeves have another drawback deriving from the afore mentioned installation and stability requirements, i.e. a sleeve of given dimensions can only be mounted on a cable of the corresponding size or else on cables of different sizes but within a very limited range. This in turn requires a large number of sleeve sizes, involving high molding, and storage costs, as well as difficult utilization.

This Patent has the scope to create a support for electric wire markers of the open sleeve type, which can be easily fitted, without failure and with great stability, on an already connected cable and which can be used on differently sized cables within a suitably large dimensional range.

This objective is reached by the sleeve, subject matter of this Patent. This sleeve, preferably in hard but elastic material, has a flat or slightly curved central portion, preferably of constant thickness, provided with two curved branches tapering down towards both ends from which two flat flanges of virtually constant thickness are bending parallely inwards until they are almost touching the center of the sleeve.

Through this solution, the sleeve becomes rather strong and the two curved branches are sufficiently spaced to permit elastic fitting of the cable without much deformation during installation. Furthermore, the two branches (or legs) need not stay snug around the cable since stability is almost entirely ensured by the two internal flanges pressing against the cable. This will eliminate failure during installation, while it will also be possible to fit the same sleeve on differently sized cables since the flanges have a very large deformation range.

The invention in question is illustrated for exemplification purposes in the enclosed drawing, in which.

Figures 1, 2, 3, 4, 5, 6, 7, 8:
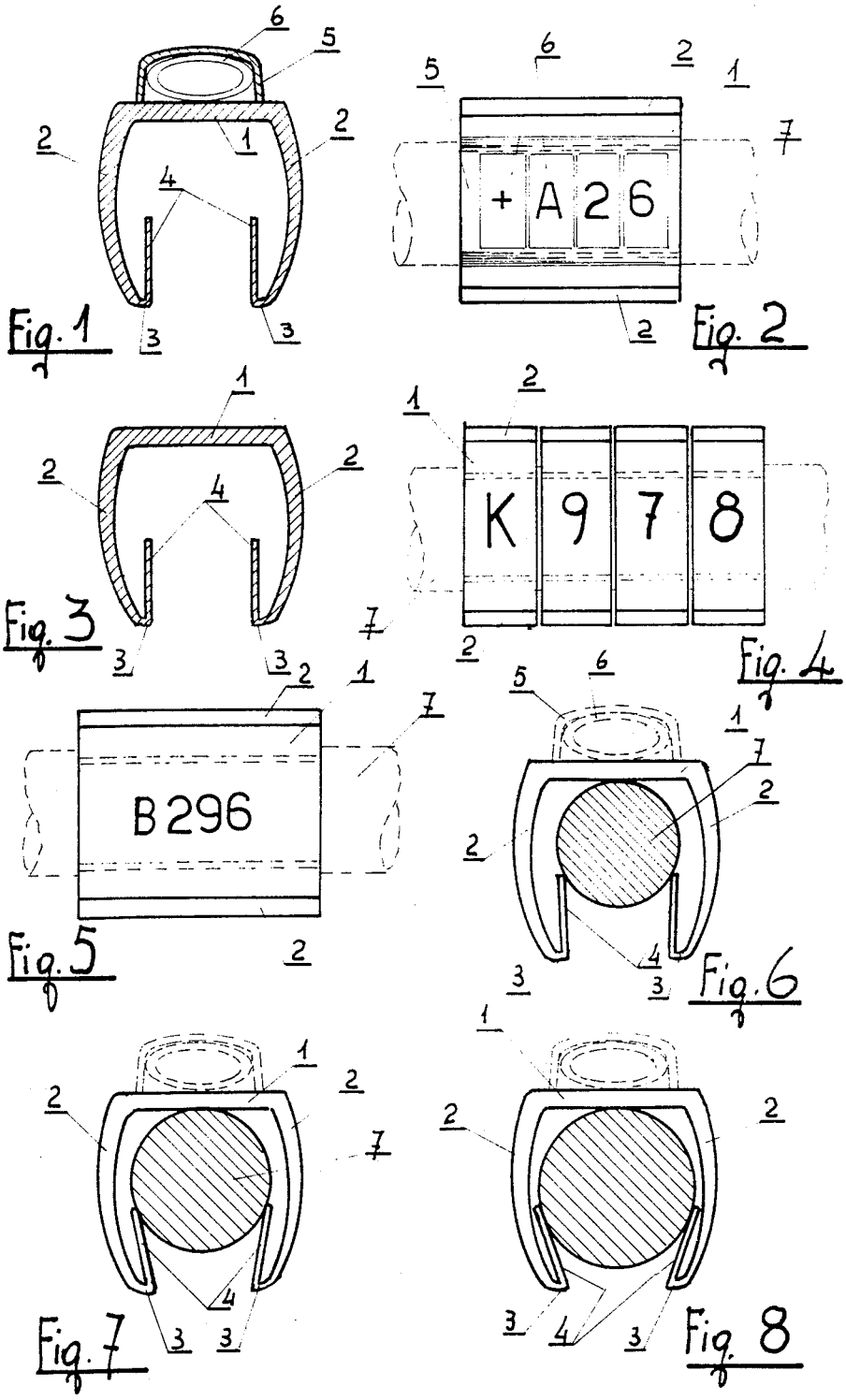
FIG. 1 shows a cross section of the exemplified open sleeve support with transparent recess in which to introduce the ringshaped marking elements.
FIG. 2 shows a top view of the support illustrated in FIG. 1.
FIG. 3 shows a cross section of an open sleeve for single or multiple marking symbols printed on its upper surface.
FIG. 4 shows a top view of the support illustrated in FIG. 3, in the composable code version.
FIG. 5 shows a top view of the support illustrated in FIG. 3 in the single code version.
FIGS. 6, 7 and 8 are showing a side view of an open sleeve support respectively mounted on three cables having different diameters.

With reference to these figures, the open sleeve is consisting of a flat or slightly curved portion 1 usually of constant thickness, from which two curved and tapering legs 2 are branched off downwards, close bend (3) radiused to two flat and parallel inwards bent flanges 4, usually having a constant thickness, almost reaching the center of the sleeve.

According to well known cable and wire marking techniques, one or more closed recesses 5 can be provided on the upper periphery 1 as shown in the illustrations or with a lateral longitudinal slot, in soft, transparent material as shown in FIGS. 1, and 2. Such open sleeve supports with hard but elastic plastic body and soft, transparent recesses are already available and stated in the U.S. Pat. No. 4,268,986. Small rings 6 are introudced in these recesses forming the required markings (e.g. in FIG. 2 the code is "+A26").

In other cases, the marking is directly printed or stamped on the upper sleeve surface as shown in FIGS. 3, 4 and 5, FIG. 4 featuring several sleeves each bearing its own index forming the required marking after assembly (for instance in FIG. 4 the code is "K978") and in FIG. 5 the complete code (e.g. "B296") appears on one single support. The supports assembled as shown in FIG. 4 may have sloping lateral surfaces or some other means to prevent reciprocal rotation.

The foregoing clearly shows the applications and advantages of the support in question, also in view of the fact that the sleeve is mounted on the already connected cable (this also facilitates the introduction or modification of the marking elements on finished or operating plants and installations); the sleeve is fitted on the cable by pushing the support sideways, so that the cable penetrates into the sleeve while slightly expanding the two branches 2 which will yield elastically, especially with their thin tapered ends.

FIG. 6 shows a sleeve mounted on a cable 7 having a minimum diameter with respect to the dimensions of the support in question and in this case, the flanges 4 will only be subject to a slight deformation but will still keep the sleeve fitted. In FIG. 7, the sleeve is mounted on an intermediate cable so that the flanges 4 will be subject to a somewhat greater strain.

FIG. 8 shows the installation of the sleeve on a maximum sized cable with respect to the dimensions of the support.

It can be observed that in this case, the internal flanges 4 are bent until they almost touch the inner walls of the branches 22 and it may well be that the material in the radiused zones 3 between the branches 3 and flanges 4 suffers permanent deformation due to the yield stress, so that the flanges 4 have no more or little elasticity; however even in such case, the stable fitting is guaranteed since the two branches 2 of the sleeve will bring to bear their elastic action on the cable.

We claim:

1. An open sleeve identification device for electrical cables, which comprises:

(a) a central body portion having opposed side edges;

(b) a pair of opposed leg portions extending from said side edges and terminating in distal ends thereof, said leg portions being tapered towards said distal ends; and (c) a pair of resilient flange portions, each connected at one end thereof to a said distal end of said leg portions by a close bend fillet and terminating in a free end thereof at approximately the mid-point of the leg portion, said flange portions having a normal position in which they are parallel, (d) said resilient flange portions being operable to be urged apart from said normal position to a more widely spaced apart position when a cable of a first size is forced therebetween toward said central body portion and to return to said normal position when said first size cable contacts said body portion, whereby said first size cable contacts and is secured between said free ends of said flange portions and said central body portion; and (e) said resilient flange portions being further operable to be urged apart from said normal position to a more widely spaced apart position when a cable of a larger size than said first size is forced therebetween toward said central body portion and to remain in a said more widely spaced position when said larger size cable contacts said body portion, whereby said larger size cable is gripped by said flange portions and contacts said central body portion.

2. The device according to claim 1, wherein said leg portions are biased toward one another, whereby said leg portions are operable to assist in securing the device to an electric cable.

3. The device according to claim 1, wherein said leg portions curve slightly inwardly toward each other.

4. The device according to claim 2, wherein said leg portions curve slightly inwardly toward each other.

5. The device according to claim 1, wherein said resilient flange paortions are of substantially constant thickness.

6. The device according to claim 1, wherein said flange portions are flat.

7. The device according to claim 2, wherein said flange portions are flat.

8. The device according to claim 3, wherein said flange portions are flat.

9. The device according to claim 4, wherein said flange portions are flat.

10. The device according to claim 1, wherein said central body portion carries identification markings on its outer surface.

11. The device according to claim 10, wherein said markings are received in recesses formed in said outer surface.

12. The device according to claim 1, wherein said open sleeve is of hard, elastic material.

* * * * *